US009528076B2

(12) United States Patent
Labeque

(10) Patent No.: US 9,528,076 B2
(45) **Date of Patent: *Dec. 27, 2016**

(54) DETERGENT COMPOSITION COMPRISING SURFACTANT BOOSTING POLYMERS

(75) Inventor: Regine Labeque, Neder-over-Heembeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 276 days.

This patent is subject to a terminal disclaimer.

(21) Appl. No.: 12/873,366

(22) Filed: Sep. 1, 2010

(65) Prior Publication Data

US 2012/0053106 A1 Mar. 1, 2012

(30) Foreign Application Priority Data

Sep. 15, 2009 (EP) ..... 09170255

(51) Int. Cl.

| | |
|---|---|
| ***C11D 3/37*** | (2006.01) |
| ***C11D 1/04*** | (2006.01) |
| ***C11D 1/12*** | (2006.01) |
| ***C11D 1/22*** | (2006.01) |
| ***C11D 1/29*** | (2006.01) |
| ***C11D 1/37*** | (2006.01) |
| ***C11D 17/04*** | (2006.01) |
| ***C11D 1/06*** | (2006.01) |
| ***C11D 1/14*** | (2006.01) |

(52) U.S. Cl.

CPC . *C11D 1/22* (2013.01); *C11D 1/06* (2013.01); *C11D 1/123* (2013.01); *C11D 1/143* (2013.01); *C11D 1/146* (2013.01); *C11D 1/29* (2013.01); *C11D 1/37* (2013.01); *C11D 3/3707* (2013.01); *C11D 3/3715* (2013.01)

(58) Field of Classification Search

CPC ... C11D 17/043; C11D 3/3707; C11D 3/3711; C11D 1/04; C11D 1/06; C11D 1/12; C11D 1/123; C11D 1/143; C11D 1/146; C11D 1/22; C11D 1/29; C11D 1/37

USPC ..... 510/407, 276, 297, 299, 336, 338, 340, 510/352, 353, 403, 404, 414, 429, 437, 510/439, 475, 498

See application file for complete search history.

(56) References Cited

U.S. PATENT DOCUMENTS

| | | | | |
|---|---|---|---|---|
| 2,220,099 | A | 11/1940 | Heidelberg et al. | |
| 2,477,383 | A | 7/1949 | Lewis | |
| 3,664,961 | A * | 5/1972 | Norris | 510/305 |
| 3,835,163 | A | 9/1974 | Rapko | |
| 3,923,679 | A | 12/1975 | Rapko | |
| 3,949,678 | A | 4/1976 | Theurer | |
| 4,102,903 | A | 7/1978 | Crutchfield et al. | |
| 4,105,827 | A | 8/1978 | Brichard et al. | |
| 4,120,874 | A | 10/1978 | Crutchfield et al. | |
| 4,158,635 | A | 6/1979 | Crutchfield et al. | |
| 4,222,905 | A | 9/1980 | Cockrell, Jr. | |
| 4,239,659 | A | 12/1980 | Murphy | |
| 4,246,612 | A | 1/1981 | Berry et al. | |
| 4,681,592 | A | 7/1987 | Hardy et al. | |
| 4,810,410 | A | 3/1989 | Diakun et al. | |
| 4,966,723 | A | 10/1990 | Hodge et al. | |
| 5,114,611 | A | 5/1992 | Van Kralingen et al. | |
| 5,227,084 | A | 7/1993 | Martens et al. | |
| 6,689,732 | B1 | 2/2004 | Guedira et al. | |
| 6,747,000 | B2 | 6/2004 | Pearce et al. | |
| 6,849,588 | B2 | 2/2005 | Elsik et al. | |
| 6,995,127 | B1 | 2/2006 | Smith et al. | |
| 7,008,914 | B2 | 3/2006 | Smith et al. | |
| 7,179,780 | B2 | 2/2007 | Forth et al. | |
| 7,329,441 | B2 | 2/2008 | Catlin et al. | |
| 7,595,290 | B2 | 9/2009 | Pounds et al. | |
| 7,677,015 | B2 | 3/2010 | Kroese et al. | |
| 7,786,027 | B2 | 8/2010 | Aouad et al. | |
| 2002/0137652 | A1 | 9/2002 | Gressel et al. | |
| 2003/0096726 | A1 | 5/2003 | Smith et al. | |
| 2004/0186035 | A1 | 9/2004 | Johnston et al. | |
| 2004/0219297 | A1* | 11/2004 | Raehse et al. | 427/292 |
| 2005/0113271 | A1* | 5/2005 | Pegelow et al. | 510/220 |
| 2006/0270582 | A1 | 11/2006 | Boeckh et al. | |
| 2006/0276364 | A1* | 12/2006 | Kouvroukoglou et al. | 510/293 |
| 2008/0015135 | A1* | 1/2008 | de Buzzaccarini et al. | 510/336 |
| 2009/0005288 | A1* | 1/2009 | Boutique et al. | 510/299 |
| 2009/0124528 | A1* | 5/2009 | Danziger et al. | 510/224 |
| 2009/0176935 | A1 | 7/2009 | Boeckh et al. | |
| 2009/0298735 | A1 | 12/2009 | Boeckh et al. | |
| 2010/0183533 | A1 | 7/2010 | Giles et al. | |
| 2010/0191012 | A1 | 7/2010 | Giles et al. | |
| 2010/0197961 | A1 | 8/2010 | Giles et al. | |
| 2010/0240569 | A1* | 9/2010 | Boutique et al. | 510/299 |
| 2010/0240571 | A1* | 9/2010 | Boutique et al. | 510/338 |
| 2010/0305020 | A1 | 12/2010 | Jennewein | |
| 2011/0061174 | A1* | 3/2011 | Boutique et al. | 8/137 |

(Continued)

FOREIGN PATENT DOCUMENTS

| | | |
|---|---|---|
| EP | 0482807 A | 4/1992 |
| WO | WO 91/09932 | 7/1991 |

(Continued)

OTHER PUBLICATIONS

U.S. Appl. No. 12/873,401, filed Sep. 1, 2010, Labeque, et al.
U.S. Appl. No. 12/873,354, filed Sep. 1, 2010, Courchay.

*Primary Examiner* — Lorna M Douyon

(74) *Attorney, Agent, or Firm* — Gregory S. Darley-Emerson; Leonard W. Lewis; Steve W. Miller

(57) ABSTRACT

The present invention relates to a compact liquid detergent composition comprising less than 25% of water by weight of the composition and further comprising surfactant, surfactant boosting polymer and fatty acid suitable for use in laundry cleaning.

23 Claims, 2 Drawing Sheets

(56) References Cited

U.S. PATENT DOCUMENTS

| | | | | |
|---|---|---|---|---|
| 2011/0240510 | A1* | 10/2011 | De Poortere et al. | 206/524.7 |
| 2011/0257062 | A1* | 10/2011 | Dykstra et al. | 510/303 |

FOREIGN PATENT DOCUMENTS

| | | | |
|---|---|---|---|
| WO | WO 98/13467 | A1 | 4/1998 |
| WO | WO 99/02636 | A1 | 1/1999 |
| WO | WO 2006/130442 | | 12/2006 |
| WO | WO 2006/130647 | A1 | 12/2006 |
| WO | WO 2009/005737 | A1 | 1/2009 |

* cited by examiner

DETERGENT COMPOSITION COMPRISING SURFACTANT BOOSTING POLYMERS

TECHNICAL FIELD

The present invention relates to a compact liquid detergent used in laundry cleaning comprising a surfactant and surfactant boosting polymer.

BACKGROUND TO THE INVENTION

A detergent composition for the use in laundry cleaning needs to function in different types of washing machines. More importantly it needs to function in both dilute and concentrate wash solutions used in different washing cycles. Previous formulas perform in dilute washing solution concentrations; however in the concentrate washing solutions, removal of hydrophobic stains is adversely affected.

Another limitation of such formulations is the overall volume of the detergent. The Applicant wants to keep the unit dosage volume compact, containing less water, however still delivering the detergent chemistry. This creates the requirement to have a formulation without any added water. Fatty acids have been used as a solvent to decrease the amount of added water and also to improve the whiteness of the laundry. However, high concentration of fatty acids can adversely effect the removal of hydrophobic stains.

In addressing this problem, the Applicant has found that by combining surfactant with a surfactant boosting polymer, a compact liquid detergent with reduced quantity of fatty acids and surfactant can be provided. The resulting composition provides improved removal of hydrophobic stains and whiteness of the laundry. Moreover the composition of the present invention performs in both diluted and concentrated washing solutions.

Polymeric ingredients are known for incorporation into cleaning compositions. For example, in WO 06/130442 and WO 06/130575 (Procter & Gamble Company) disclose a detergent composition comprising cleaning polymer. WO 91/09932 (Unilever), polymers are described as deflocculating polymers are incorporated into detergent composition particles to provide improved dispersing granular detergent compositions. Graft polymers are known for incorporation into detergent compositions, for example as described in WO 07/138,053 (BASF Aktiengesellschaft) and WO 07/138,054 (Procter & Gamble Company).

SUMMARY OF THE INVENTION

A compact liquid detergent composition comprising less than 25% water of the weight of the composition and comprising a surfactant and a surfactant boosting polymer, which increases the gradient of the decline in interfacial surface tension by at least 15%, and fatty acid.

DETAILED DESCRIPTION OF THE INVENTION

Figure 1:
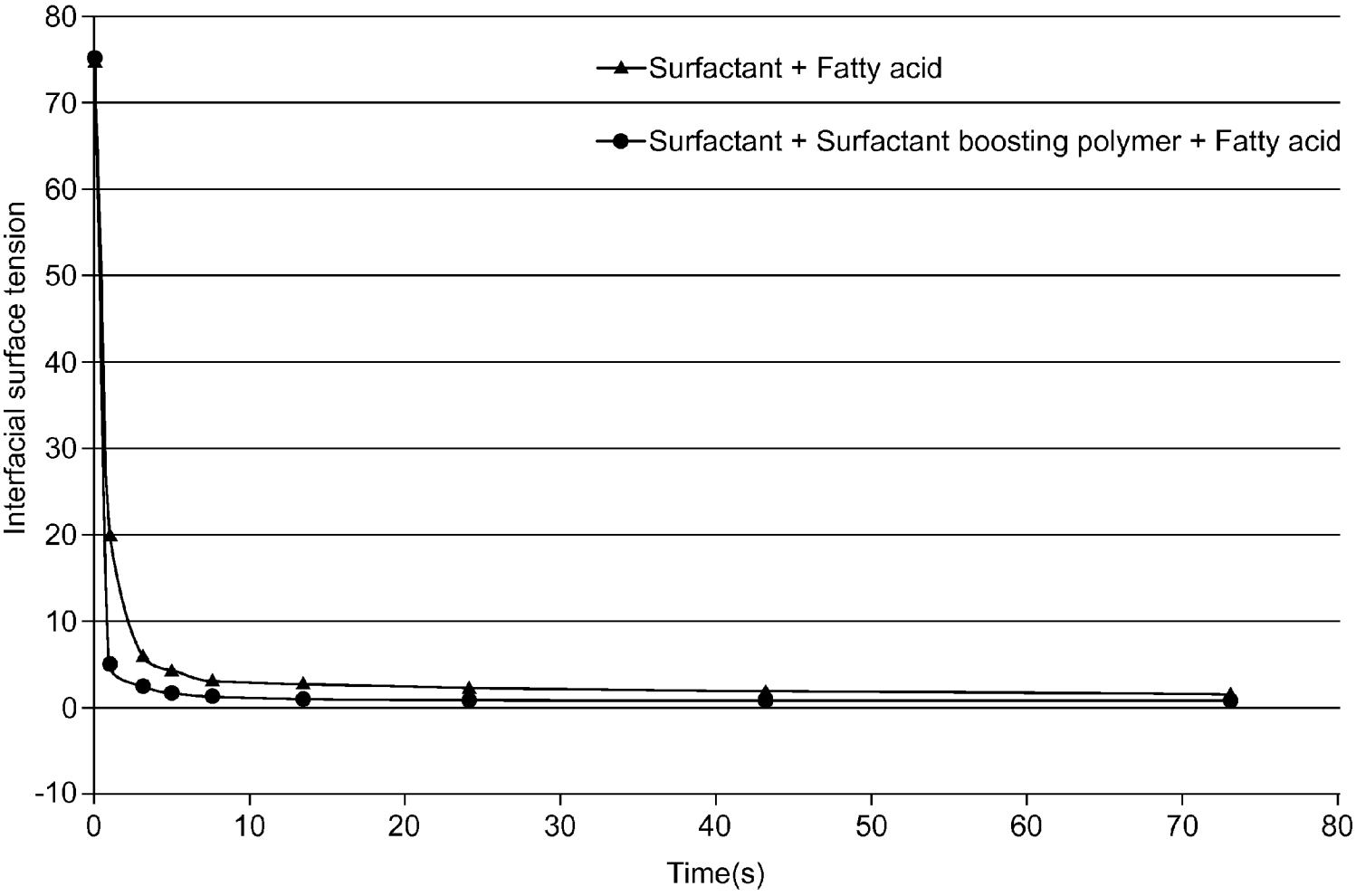
FIG. 1 illustrates the interfacial surface tension measured for compact liquid detergent composition comprising surfactant and fatty acid and for compact liquid detergent composition comprising surfactant, surfactant boosting polymer and fatty acid.

The compact liquid detergent of the present invention is suitable for use in a water-soluble pouch, more preferably a multi-compartment water-soluble pouch, or as a conventional liquid detergent conserved in containers.

Detergent Composition

The composition of the present invention is a compact liquid. By the term 'liquid' it is meant to include liquid, paste, waxy or gel compositions. The liquid composition may comprise a solid. Solids may include powder or agglomerates, such as micro-capsules, beads, noodles or one or more pearlised balls or mixtures thereof. Such a solid element may provide a technical benefit, through the wash or as a pre-treat, delayed or sequential release component. Alternatively it may provide an aesthetic effect.

By the term 'compact' is meant to include liquid, paste, waxy or gel compositions which comprise less than 25% water by the weight of composition.

In a preferred embodiment the present composition is in the form of a water-soluble pouch, more preferably a multi-compartment pouch. The water-soluble pouch, wherein present, comprises a water-soluble film and at least a first, and optionally a second compartment. The first compartment comprises a first composition, comprising a surfactant, a surfactant boosting polymer(s) and fatty acid. The second compartment, where present comprises a second, preferably different composition. Preferably the pouch comprises a third, compartment and preferably different third composition. The optionally second and third compositions are preferably visibly distinct from each other and the first composition.

The weight ratio of the first and second or third liquid compositions, where present, is preferably from 1:1 to 20:1, more preferably from 2:1 to 10:1. The weight ratio of the second to third composition, where present, is from 1:5 to 5:1, more preferably 1:2 to 2:1. Most preferably the weight ratio of second to third composition is 1:1.

The construction of the multi-compartment pouch provides benefits in terms of aesthetic appeal. A further benefit of said construction is the ability to separate, otherwise incompatible, ingredients. In a preferred aspect of the present invention, the first composition comprises the main wash detergent.

Surfactants

A surfactant is an essential component of the present invention. The detersive surfactants utilized can be of the anionic, nonionic, zwitterionic, ampholytic or cationic type or can comprise compatible mixtures of these types. The term surfactant, as used herein, does not include fatty acids or soaps thereof. More preferably surfactants are selected from the group consisting of anionic, nonionic, cationic surfactants and mixtures thereof. In one embodiment, the compositions are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Non-soap anionic surfactants which are suitable for use herein include the water-soluble salts, preferably the alkali metal, and ammonium salts, of organic sulfuric reaction products having in their molecular structure an alkyl group containing from 10 to 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from 9 to 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to 80. Particularly preferred are condensation products of $C_{12}$-$C_{15}$ alcohols with from 5 to 20 moles of ethylene oxide per mole of alcohol, e.g., $C_{12}$-$C_{13}$ alcohol condensed with 6.5 moles of ethylene oxide per mole of alcohol.

The mean weight average molecular weight $M_w$ of the surfactants in present invention is preferably from 200 to 850, preferably from 250 to 700.

The composition of the present invention preferably comprises from 1% to 80% surfactant by weight of the compact liquid detergent composition. Surfactant is a component of the first composition. Preferably said first composition comprises from 5% to 50% surfactant by weight of the compact liquid detergent composition. The second and third compositions, where present, may comprise surfactant at levels of from 0.1% to 99%.

When the selected surfactant is LAS, the composition comprises preferably from 5% to 30% of LAS by weight of the compact liquid detergent composition, more preferably from 7% to 25% of LAS by weight of the compact liquid detergent composition.

Surfactant Boosting Polymer

The composition of the present invention comprises a surfactant boosting polymer. The most common purpose of a surfactant is to emulsify or disperse one liquid phase into another—usually the oil phase into water. When two immiscible liquids are in contact, a boundary forms between them. Increasing the interface area, results in the dispersion of one phase into another as small droplets. The lower the interfacial surface tension, the more one phase is emulsified into other. Therefore a low interfacial surface tension is correlated with cleaning efficiency in cleaning and laundering. By the term surfactant boosting polymer is meant polymers capable of increasing the gradient of the decline in the interfacial surface tension. FIG. 1 illustrates this effect; the interfacial surface tension is plotted against surface age. Additionally FIG. 1 show that the surface tension for the compact liquid detergent composition comprising surfactant, surfactant boosting polymer and fatty acid has a steeper gradient of the decline in interfacial surface tension compared to the gradient of the compact liquid detergent composition comprising only surfactant and fatty acid. The interfacial tension decreases as the surface age increases, surfactant boosting polymers of the present invention boost this decrease to occur faster.

FIG. 1

The interfacial tension can for example be measured using Kruss prop volume Tensiometer (Kruss DV1030) using the same concentration of surfactant, surfactant boosting polymer and fatty acid as found in the wash solution as compared to the same composition but with surfactant alone.

The chamber for the bulk phase is filled with the solution of the surfactant containing detergent with and without surfactant boosting polymer and fatty acids. The chamber for the dispensed phase (oil) is filled with the oil. The principle of the equipment is that the oil is automatically pumped into the bulk phase from the bottom of the chamber at a given flow rate. The surfactant or surfactant/polymer from the bulk phase migrates to the oil droplet. As a result the oil droplet size increases and the surface tension decreases. When the surface tension is low enough the oil droplet migrates to the top and is automatically detected (with a light beam). The equipment calculates the time it takes for the oil to reach the detector. This is referred as surface age. The measurement will be repeated for several oil dispensing flow rates. The range of flow rate is provided before the start of the experiment and ranges from 0.001 μl/min to 500 μl/min. Flow-rate steps evenly distributed in time are also provided and are typically 20 to 30; i.e. there will be 20 to 30 data points. For each point, surface tension is calculated and provided as an output from the equipment. Surface tension is calculated according to the following equation. Densities of the bulk and oil phases are measured with conventional density equipment, e.g. Anton Paar DMA 38 (Anton Paar Benelux BVBA. Gentbrugge, BELGIUM).

$$\sigma i = \frac{Vdrop \times (\rho H - \rho L)g}{\pi d}$$

σi=interfacial tension

Vdrop=volume of drop

ρH=density of bulk phase

ρL=density of oil phase g=acceleration due to gravity (provided by supplier of equipment)

d=diameter of capillary (254 micrometer)

Test Method:

Oil (100 g) is prepared by mixing 33.33 g sunflower oil with 33.33 g corn grain oil and 33.33 g arachnid oil.

Detergent solutions are prepared by adjusting the concentration to be the same as the detergent concentration in a washing machine during the washing cycle 1 g/l surfactant and 2.5 g/l detergent for Western European conditions. First detergent solution contains surfactant, surfactant boosting polymer and fatty acid and second detergent solution contains only the surfactant and fatty acid. The test can be done also in North American conditions having concentrations 0.16 g/l of surfactant and 0.4 g/l detergent.

The temperature is set to 40° C. during the test; however the test can be done at temperatures from 15° C. to 40° C.

The hardness of the detergent solutions is set to 2.5 mmol for the whole duration of the test. However the test can be done at hardness from 1 to 4 mmol Ca/Mg (Ca/Mg ratio is 3:1)

Figure 2:
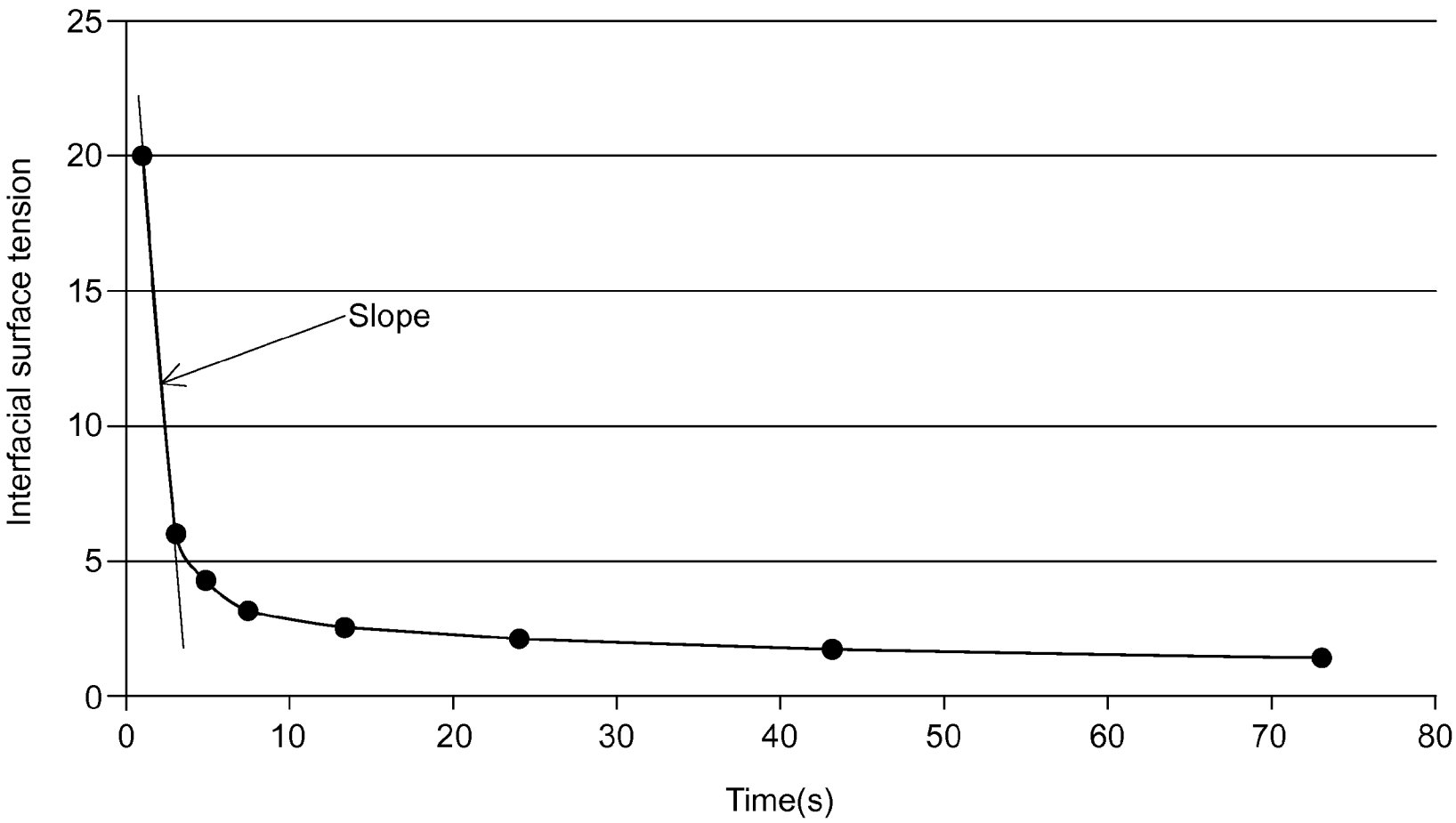
FIG. 2 illustrates the gradient of the decline in interfacial surface tension.

The surfactant boosting polymers of the present invention increase the gradient of the decline in interfacial surface tension. This gradient can be measured from the slope of interfacial surface tension reduction versus time. The gradient is equal to the absolute magnitude of the slope of the curve of interfacial surface tension versus time measured over the interval at $t_1$=0 s and $t_2$=3 s. This is illustrated in FIG. 2.

The gradient of the decline in interfacial surface tension can be calculated:

$$\text{Gradient} = \frac{|\sigma i(T2)| - |\sigma i(T1)|}{T2 - T1} = \frac{\Delta \sigma i}{\Delta T}$$

Gradient=the gradient of the decline in interfacial surface tension

FIG. 2

A suitable surfactant boosting polymer for the present invention is polymer, which increases the gradient of the decline in interfacial surface tension by at least 15%.

It is further believed that the surfactant boosting polymers induce the micellisation of surfactants by reducing apparent critical micelle concentration in the presence of hardness ions ($Mg^{2+}$ and $Ca^{2+}$) in water. The critical micelle concentration (CMC) is defined as the concentration of surfactants above which micelles are spontaneously formed. Micellisation of surfactant and polymers may prevent formation of the calcium salt lamellae maintaining surfactant in solution.

Additionally surfactant boosting polymers aid the collapse of micelles on fats. A key feature of the surfactant boosting polymer is their amphiphilicity. They have a balanced ratio of hydrophobic and hydrophilic structural elements. Hence they are firstly hydrophobic enough to absorb a hydrophobic soil and to remove it with the surfactants from a surface. Secondly it is hydrophilic enough to keep the detached hydrophobic soil in the washing and cleaning liquor and prevent it from redepositing onto the surface. For example in the polyethylene glycol polyvinyl acetate (PEG-PVAc) polymer; hydrophobic PVAc part of the PEG-PVAc polymer ensures interaction with surfactant and hydrophobic grease stains, while the hydrophilic polyethylene glycol PEG part of the PEG-PVAc polymer keeps the polymer-surfactant structures dispersed in water.

The amphiphilic surfactant boosting polymers in the present invention are preferably based on water-soluble polyalkylene oxides as the hydrophilic back bone and hydrophobic side chains formed by polymerization of a vinyl ester component. Said polymers preferably have an average of one or less graft site per 50 alkylene oxide units and mean molar masses $M_w$ from 3000 to 100,000.

The suitable surfactant boosting polymers for the present invention are preferably characterised by their low degree of branching. They have, on average, based on the reaction mixture obtained, not more than 1 graft site, preferably not more than 0.6 graft site, more preferably not more than 0.5 graft site and most preferably not more than 0.4 graft site per 50 alkyleneoxide units. They comprise, on average, based on the reaction mixture obtained, preferably at least 0.05, in particular at least 0.1 graft site per 50 alkyleneoxide units.

The mean weight average molecular weight $M_w$ of the surfactant boosting polymers in present invention is preferably from 3000 to 100,000, preferably from 6000 to 45,000 and more preferably from 8000 to 30,000.

In preferred embodiments of the surfactant boosting polymers feature a narrow molar mass distribution and hence a polydispersity $M_w/M_n$ is generally 3 or less, preferably 2.5 or less and more preferably 2.3 or less. Most preferably the polydispersity $M_w/M_n$ is in the range from 1.5 to 2.2. The polydispersity $M_w/M_n$ is a measure of the distribution of molecular mass in a given polymer sample. The polydispersity is calculated by dividing the weight average molecular weight by the number average molecular weight.

The amphiphilic surfactant boosting polymers preferably comprises from 25% to 60% water-soluble polyalkylene oxide as a hydrophilic backbone, more preferably less than 50%, most preferable 40% hydrophilic polyalkylene oxide backbone. The hydrophobic side chains of the surfactant boosting polymer preferably comprise from 40% to 75% of a polyvinyl ester component, preferably more than 50% and most preferably 60% of the polyvinyl ester component Water-soluble polyalkylene oxides suitable for forming the hydrophilic backbone are in principle all polymers based on C2-C4-alkylene oxides which comprise at least 50% by weight, preferably at least 60% by weight, more preferably at least 75% by weight ethylene oxide in copolymerized form.

The polyalkylene oxide preferably has a low polydispersity $M_w/M_n$. Their polydispersity is preferably 1.5 or less.

The polyalkylene oxides may be the corresponding polyalkylene glycols in free form, i.e. with OH end groups, but they may also be capped at one or both end groups. Suitable end groups are, for example, $C_1$-$C_{25}$-alkyl, phenyl and C1-C14-alkylphenyl groups. Specific examples of particularly suitable polyalkylene oxides include: a) Polyethylene glycols which may be capped at one or both end groups, especially by C1-C25-alkyl groups, but are preferably not etherified, and have mean molar masses $M_n$ of preferably from 1500 to 20,000, more preferably from 2500 to 15,000. b) Copolymers of ethylene oxide and propylene oxide and/or butylene oxide with an ethylene oxide content of at least 50% by weight, which may likewise be capped at one or both end groups, especially by C1-C25-alkyl groups, but are preferably not etherified, and have mean molar masses $M_n$ of preferably from 1500 to 20,000, more preferably from 2500 to 15,000. c) Chain-extended products having mean molar masses of in particular from 2500 to 20,000, which are obtainable by reacting polyethylene glycols having mean molar masses $M_n$ of from 200 to 5000 or copolymers having mean molar masses $M_n$ of from 200 to 5000 with C2-C12-dicarboxylic acids or -dicarboxylic esters or $C_6$-$C_{18}$-diisocyanates. Preferred hydrophilic backbones and graft bases are the polyethylene glycols.

The side chains of the surfactant boosting polymers are formed by polymerization of a vinyl ester component in the presence of the hydrophilic back bone. The vinyl ester component may consist advantageously of vinyl acetate or vinyl propionate or of mixtures of vinyl acetate and vinyl propionate, particular preference being given to vinyl acetate as the vinyl ester component.

However, the side chains of the surfactant boosting polymer can also be formed by copolymerizing vinyl acetate and/or vinyl propionate and a further ethylenically unsaturated monomer. The fraction of monomer in the vinyl ester component may be up to 30% by weight.

Suitable comonomers are, for example, monoethylenically unsaturated carboxylic acids and dicarboxylic acids and their derivatives, such as esters, amides and anhydrides, and styrene. It is of course also possible to use mixtures of different comonomers. Specific examples include: (meth) acrylic acid, C1-C12-alkyl and hydroxy-C2-C12-alkyl esters of (meth)acrylic acid, (meth)acrylamide, N—C1-C12-alkyl(meth)acrylamide, N,N-di(C1-C6-alkyl)(meth)acrylamide, maleic acid, maleic anhydride and mono(C1-C12-alkyl)esters of maleic acid. Preferred monomers are the C1-C8-alkyl esters of (meth)acrylic acid and hydroxyethyl acrylate, particular preference being given to the C1-C4-alkyl esters of (meth)acrylic acid. Very particularly preferred monomers are methyl acrylate, ethyl acrylate and in particular n-butyl acrylate.

Most preferred surfactant boosting polymer is PEG-PVAc. PEG-PVAc is graft copolymer of glycol and vinyl acetate. In a preferred embodiment the surfactant boosting polymer has a monomer composition 40% of ethylene oxide and 60% vinyl acetate by weight.

Most preferred surfactant booster polymers for the present invention are known under the trade reference Sokalan PG101 (PEG-PVAc), Sokalan and Sokalan HP22 sold by BASF Aktiengesellschaft, Ludwigshafen, Germany. Surfactant boosting polymers useful herein are described in WO 2007/138053 (BASF Aktiengesellesschaft), WO/2007/138054 (Procter & Gamble Company).

The compact liquid detergent composition of the present application comprises from 0.1% to 10% surfactant boosting polymer by weight of the compact liquid detergent composition, preferably from 3% to 8% surfactant boosting polymer by weight of the compact liquid detergent composition and more preferably from 3.5% to 4.5% surfactant boosting polymer by weight of the compact liquid detergent composition.

Fatty Acids

The composition of the present invention comprises a fatty acids or fatty acid salts. The fatty acids are carboxylic acids which are often with a long unbranched aliphatic tail, which is either saturated or unsaturated. Suitable fatty acids or salts of the fatty acids for the present invention are preferably sodium salts, preferably C12-C18 saturated and/or unsaturated fatty acids more preferably C12-C14 saturated and/or unsaturated fatty acids and alkali or alkali earth metal carbonates preferably sodium carbonate.

Preferably the fatty acids are selected from the group consisting of lauric acid, myristic acid, palmitic acid, stearic acid, topped palm kernel fatty acid, coconut fatty acid and mixtures thereof.

The compact liquid detergent composition of the present application comprises from 2% to 18% fatty acids by weight of the compact liquid detergent composition, preferably from 4% to 13% fatty acids by weight of the compact liquid detergent composition and most preferably from 5% to 10% fatty acids by the weight of the compact liquid detergent composition.

Optional Detergent Composition Components

The composition of the present invention may comprise one or more of the ingredients as discussed below.

Solvent System

The solvent system in the present compact liquid detergent compositions can be a mixture of organic solvents. The present composition does not contain any added water. High water content may have an unwanted effect on the film properties. Additionally too high or too low water content may have negative impact on detergent composition i.e. by causing phase separation. The water in the composition origins from the raw materials. Preferred organic solvents include 1,2-propanediol, ethanol, glycerol, dipropylene glycol, methyl propane diol and mixtures thereof. Other lower alcohols, C1-C4 alkanolamines such as monoethanolamine and triethanolamine, can also be used. Solvent systems can be absent, for example from anhydrous solid embodiments of the invention, but more typically are present at levels in the range of from 0.1% to 98%, preferably at least 1% to 50%, more usually from 5% to 25% by weight of the compact liquid detergent composition.

Water is typically present at levels in the range from 5% to 25%, preferably from 7% to 20% more preferably from 8% to 15% by the weight of the compact liquid detergent composition.

Opacifier

The compact liquid detergent composition may comprise an opacifier. An opacifier according to the present invention is a solid, inert compound which does not dissolve in the composition and refracts, scatters or absorbs most light wavelengths.

The opacifier is preferably selected from the group consisting of styrene/acrylate latexes, titanium dioxide, tin dioxide, any forms of modified $TiO_2$, for example carbon modified $TiO_2$ or metallic doped (e.g. Platinum, Rhodium) $TiO_2$ or stannic oxide, bismuth oxychloride or bismuth oxychloride coated $TiO_2$/Mica, silica coated $TiO_2$ or metal oxide coated and mixtures thereof. Particularly preferred styrene/acrylate latexes are those available from the Rohm & Haas Company sold under the trademark Acusol. The latexes are characterized by pH of about 2 to about 3, having approximately 40% solids in water, with particle size of about 0.1 to about 0.5 micron. Specifically preferred Acusol® polymers include Acusol® OP301 (styrene/acrylate) polymer, Acusol® OP302, (Styrene/Acrylate/Divinylbenzene Copolymer), Acusol® OP303 (Styrene/Acrylamide Copolymer), Acusol® OP305 (Styrene/PEG-10 Maleate/Nonoxynol-10 Maleate/Acrylate Copolymer) and (Styrene/Acrylate/PEG-10 Dimaleate Copolymer) and mixtures thereof. Preferred species have molecular weight of from 1000 to 1 000 000, more preferably from 2000 to 500 000, most preferably from 5000 to 20 000.

The opacifier is preferably present in sufficient amount to leave the composition, in which it is incorporated, white. Where the opacifier is an inorganic opacifier (e.g. $TiO_2$, or modifications thereof) the opacifier is preferably present at a level of from 0.001% to 1%, more preferably from 0.01% to 0.5%, most preferably from 0.05% to 0.15% by weight of the composition.

Where the opacifier is an organic opacifier (e.g. styrene/acrylate latexes), the opacifier is preferably present at a level of from 0.001% to 2.5%, more preferably from 1% to 2.2%, most preferably from 1.4% to 1.8% by weight of the compact liquid detergent composition.

Antioxidant

The compact liquid detergent composition may comprise an antioxidant. The second and third compositions, when present, may also comprise antioxidant. Although not wishing to be bound by theory, the Applicants believe that the presence of antioxidant reduced or preferably stops the reaction of reactive compounds in the formula e.g. perfumes, which tend to be oxidized over time and higher temperature and which can lead to yellowing.

An antioxidant according to the present invention, is a molecule capable of slowing or preventing the oxidation of other molecules. Oxidation reactions can produce free radicals, which in turn can start chain reactions of degradation. Antioxidants terminate these chain reactions by removing the free radical intermediates and inhibiting other oxidation reactions by being oxidized themselves. As a result antioxidants are often reducing agents. The antioxidant is preferably selected from the group consisting of butylated hydroxyl toluene (BHT), butylated hydroxyl anisole (BHA), trimethoxy benzoic acid (TMBA), α, β, λ and δ tocophenol (vitamin E acetate), 6 hydroxy-2,5,7,8-tetra-methylchroman-2-carboxylic acid (trolox), 1,2, benzisothiazoline-3-one (proxel GLX), tannic acid, galic acid, Tinoguard AO-6, Tinoguard TS, ascorbic acid, alkylated phenol, ethoxyquine 2,2,4 trimethyl, 1-2-dihydroquinoline, 2,6 di or tert or butyl hydroquinone, tert, butyl, hydroxyl anisole, lignosulphonic acid and salts thereof, benzofuran, benzopyran, tocopherol sorbate, butylated hydroxyl benzoic acid and salts thereof, galic acid and its alkyl esters, uric acid, salts thereof and alkyl esters, sorbic acid and salts thereof, dihydroxy fumaric acid and salts thereof, and mixtures thereof. Preferred antioxidants are those selected from the group consisting of alkali and alkali earth metal sulfites and hydrosulfites, more preferably sodium sulfite or hydrosulfite.

The antioxidant is preferably present at a level of from 0.01% to 2%, more preferably from 0.1% to 1%, most preferably from 0.3% to 0.5% by weight of the compact liquid detergent composition.

Where inorganic opacifier is used, the opacifier and antioxidant are preferably present at a ratio of from 0.1 to 0.5, more preferably from 0.12 to 0.35. Whereas, where an organic opacifier is used, opacifier and antioxidant are preferably present at a ratio of from 2 to 6, more preferably from 3 to 5.

Rheology Modifier

In a preferred embodiment the compact liquid detergent composition comprises a rheology modifier. The rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Polymeric rheology modifiers are preferably selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Fabric Care Benefit Agents

The compact liquid detergent compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the compact liquid detergent composition are suitably at levels of up to 30% by weight of the compact liquid detergent composition, more typically from 1% to 20%, preferably from 2% to 10%.

Detersive Enzymes

Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compact liquid detergent compositions are from 0.0001% to 5%. When enzymes are present, they can be used at very low levels, e.g., from 0.001% or lower, in certain embodiments of the invention; or they can be used in heavier-duty laundry detergent formulations in accordance with the invention at higher levels, e.g., 0.1% and higher. In accordance with a preference of some consumers for "non-biological" detergents, the present invention includes both enzyme-containing and enzyme-free embodiments.

Deposition Aid

As used herein, "deposition aid" refers to any cationic polymer or combination of cationic polymers that significantly enhance the deposition of a fabric care benefit agent onto the fabric during laundering. Preferably, the deposition aid is a cationic or amphoteric polymer. The amphoteric polymers of the present invention will also have a net cationic charge, i.e.; the total cationic charges on these polymers will exceed the total anionic charge. Nonlimiting examples of deposition enhancing agents are cationic polysaccharides, chitosan and its derivatives and cationic synthetic polymers. Preferred cationic polysaccharides include cationic cellulose derivatives, cationic guar gum derivatives, chitosan and derivatives and cationic starches.

Builder

The compact liquid detergent compositions may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. Particularly preferred are citrate builders, e.g., citric acid and soluble salts thereof (particularly sodium salt). Other preferred builders include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA), aluminosilicates such as zeolite A, B or MAP.

Bleaching System

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from 1% to 40% by weight, preferably from 2% to 30% by weight and more preferably from 5% to 25% by weight of compact liquid detergent composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from 0.5% to 25%, preferably from 1% to 10% by weight of compact liquid detergent composition while the preformed organic peroxyacids themselves are typically incorporated at levels in the range from 0.5% to 25% by weight, more preferably from 1% to 10% by weight of compact liquid detergent compositino. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes U.S. Pat. No. 4,810,410).

Whitening Agent

A compact liquid detergent composition may comprise a whitening agent. Such dyes have been found to exhibit good tinting efficiency during a laundry wash cycle without exhibiting excessive undesirable build up during laundering. The whitening agent is included in the total laundry detergent composition in an amount sufficient to provide a tinting effect to fabric washed in a solution containing the detergent. In one embodiment, a multi-compartment pouch comprises, by weight, from 0.0001% to 1%, more preferably from 0.0001% to 0.5% by weight of the compact liquid detergent composition, and even more preferably from 0.0001% to 0.3% by weight of the compact liquid detergent composition.

Pearlescent Agent

The compact liquid detergent compositions of the present invention may comprise a pearlescent agent. Said pearlescent agent may be organic or inorganic, but is preferably inorganic. Most preferably the pearlescent agent is selected from mica, $TiO_2$ coated mica, bismuth oxychloride or mixtures thereof.

Perfume

Perfumes are preferably incorporated into the compact liquid detergent compositions of the present invention. The perfumes may be prepared as a premix liquid, may be linked with a carrier material, such as cyclodextrin or may be encapsulated. When encapsulated the perfumes are preferably encapsulated in a melamine/formaldehyde coating.

Other Adjuncts

Examples of other suitable cleaning adjunct materials include, but are not limited to; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents and mixtures thereof.

Composition Preparation

The compact detergent compositions herein can generally be prepared by mixing the ingredients together. If a pearlescent material is used it should be added in the late stages of mixing. If a rheology modifier is used, it is preferred to first form a pre-mix within which the rheology modifier is dispersed in a portion of the water and optionally other ingredients eventually used to comprise the compositions. This pre-mix is formed in such a way that it forms a structured liquid. To this structured pre-mix can then be added, while the pre-mix is under agitation, the surfactant(s) and essential laundry adjunct materials, along with water and whatever optional detergent composition adjuncts are to be used.

Pouch Material

When the compact liquid detergent composition is packed into the pouches, the pouch is preferably made of a film material which is soluble or dispersible in water, and has a water-solubility of at least 50%, preferably at least 75% or even at least 95%. The water-solubility is measured by the method set out here after using a glass-filter with a maximum pore size of 20 microns: 50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred pouch materials are polymeric materials, preferably polymers which are formed into a film or sheet. The pouch material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from 1000 to 1,000,000, more preferably from 10,000 to 300,000 yet more preferably from 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of 10,000-40,000, preferably around 20,000, and of PVA or copolymer thereof, with a weight average molecular weight of 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising 1-35% by weight polylactide and 65% to 99% by weight polyvinyl alcohol. Preferred for use herein are polymers which are from 60% to 98% hydrolysed, preferably 80% to 90% hydrolysed, to improve the dissolution characteristics of the material.

Naturally, different film material and/or films of different thickness may be employed in making the compartments of the present invention. A benefit in selecting different films is that the resulting compartments may exhibit different solubility or release characteristics.

Most preferred pouch materials are PVA films known under the trade reference Monosol M8630, as sold by MonoSol LLC of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

For reasons of deformability pouches or pouch compartments containing a component which is liquid will preferably contain an air bubble having a volume of up to 50%, preferably up to 40%, more preferably up to 30%, more preferably up to 20%, more preferably up to 10% of the volume space of said compartment.

Process for Making the Water-Soluble Pouch

The process of making the water-soluble pouch may be made using any suitable equipment and method. Single compartment pouches are made using vertical, but preferably horizontal form filling techniques commonly known in the art.

The process for making a water-soluble pouch has been described in EP1504994 (Procter & Gamble Company) and WO02/40351 (Procter & Gamble Company). The process for making a multi-compartment water-soluble pouch has been described in co-pending patent application 09161692.0, published as WO2010141301A1, filed Jun. 2, 2009 (Procter & Gamble Company).

Secondary Packaging

The multi-compartment pouches of the present invention are preferably further packaged in an outer package. Said outer package may be a see-through or partially see-through container, for example a transparent or translucent bag, tub, carton or bottle. The pack can be made of plastic or any other suitable material, provided the material is strong enough to protect the pouches during transport. This kind of pack is also very useful because the user does not need to open the pack to see how many pouches there are left. Alternatively, the pack can have non-see-through outer packaging, perhaps with indicia or artwork representing the visually-distinctive contents of the pack.

Process of Washing

The compact liquid detergent of the present invention is suitable for laundry cleaning applications. The compact liquid detergent is suitable for hand or machine washing conditions. When machine washing, the compact liquid detergent may be delivered from the dispensing drawer or may be added directly into the washing machine drum either in a form of water-soluble pouches or in a form of compact liquid.

EXAMPLES

The following are examples of the detergents of the present invention:

Formulations

| Ingredient Name | Composition A WT % | Composition B WT % |
|---|---|---|
| Linear Alkyl benzene sulfonic acid | 14.8 | 14.8 |
| C12-14 alkyl ethoxy 3 sulfate MEA salt | 8.8 | 8.6 |
| C12-14 alkyl 7-ethoxylate | 13.0 | 12.0 |
| C12-18 Fatty acid | 15.0 | 8.5 |

-continued

| Ingredient Name | Composition A WT % | Composition B WT % |
|---|---|---|
| Enzymes | 2.3 | 2.3 |
| PEG-PVAc Polymer[1] | 0.0 | 4.0 |
| Buffer (Monoethanol amine) | To pH 7.5 | |
| Solvent | 18.6 | 17.0 |
| Color | 0.0004 | 0.0004 |
| Water | 9.5 | 9.5 |
| Miscellaneous/Minors | to 100 | to 100 |

[1]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

Performance:

The performance of Composition A and B were measured on several stains. Burnt Butter, Bacon Grease, Barbecue Sauce and Grass were applied to cotton and obtained from Equest (UK). Stains and ballast load, consisting of 5 lbs of T-shirt and pillow cases, were added to a Kenmore Top Loader Serie 80 washing machine representing a medium US wash conditions. The wash water was set at 32.2° C.±1° C. and 6 gpg (1 mmol/L) hardness and the rinse water was set at 15.5° C.±1° C. The water volume was 17 gallons and wash time 12 minutes. Two different washing machines were used and the test was run with 2 internal and 4 external replicates according to the following table:

| Run | Machine #1 | Machine #2 |
|---|---|---|
| 1 | A1-A1' | B1-B1' |
| 2 | B2-B2' | A2-A2' |
| 3 | A3-A3' | B3-B3' |
| 4 | B4-B4' | A4-A4' |

The stains and the ballast were dried at the end of each cycle under high speed and high heat with cool down cycle. The results were then analyzed by image analysis which is a method that enables to calculate the amount of stain that is removed. Stains are imaged before washing and after washing. The imaging calculates the amount of stain removal index (SRI). SRI of 100 means complete removal and SRI of zero is no removal.

The Laundry Image Analysis system (Merlin image analysis system) measures stain removal on technical stain swatches. The system utilizes a video camera to acquire color images of swatches. An image of the swatch is taken before and after it is washed. The acquired image is then analyzed by computer software (Global R&D computing). The software compares the unwashed stain to the washed stain, as well as the unwashed fabric to the washed fabric and produces five figures of merit which describe stain removal. The data are then analyzed statistically to determine statistically significant differences between the detergent performances.

The result is expressed within a percentage of a stain removal index. The stain removal index uses the initial fabric as the reference against which to measure color differences between unwashed and washed stains. A higher value indicates a better cleaning and stain removal thus a better detergent.

Performance (Stain removal Index, the higher the number the higher the removal). Full scale performance test (TL, Kenmore machine, 32.2° C. Wash and 15.5° C. Rinse, 6 gpg)

| Greasy Stains | A 67.5 | B 74.1 | StdDev |
|---|---|---|---|
| Burnt Butter | 59.2 | 68.9 | 2.7 |
| Bacon Grease | 51.3 | 59.0 | 3.6 |
| BBQ | 91.9 | 94.4 | 1.0 |
| Grass | 64.0 | 85.1 | 3.8 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cite in the Detailed Description of the Invention are, in relevant part, incorporated herein by reference, the citation of any document is not to be construed as an admission that it is prior art with respect to the present invention. To the extent that any meaning or definition of a term in this document conflicts with any meaing or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A compact liquid detergent composition comprising from 8 to 15% water by weight of the composition and comprising a surfactant and a surfactant boosting polymer, which increases the gradient of the decline in interfacial surface tension by at least 15%, and from 5% to 10% fatty acid(s) or their salts by weight of the composition, the composition comprising 3% to 8% of said surfactant boosting polymer by weight of the composition, wherein said surfactant boosting polymer comprises from 25% to 60% of hydrophilic backbone, and from 75% to 40% of hydrophobic side chains, said composition further comprising from 17% to 50% of an organic solvent system by weight of the composition, wherein said solvent system comprises a C1-C4 alkanolamine, wherein said composition further comprises a rheology modifier, and wherein said composition is encapsulated in a water-soluble pouch.

2. A compact liquid detergent composition according to claim 1 wherein said surfactant boosting polymer comprises from 25% to 50% of hydrophilic backbone, and from 50% to 75% of hydrophobic side chains.

3. A compact liquid detergent composition according to claim 1 wherein said surfactant boosting polymer comprises 40% of hydrophilic backbone, and from 60% of hydrophobic side chains.

4. A compact liquid detergent composition according to claim 1 wherein said hydrophilic backbone of the surfactant boosting polymer is selected from the group consisting of ethylene oxide, propylene oxide, butylene oxide and mixtures thereof and hydrophobic side chains of the surfactant boosting polymers are selected from the group consisting of vinyl acetate and vinyl propionate and mixtures thereof.

5. A compact liquid detergent composition according to claim 1 wherein the surfactant boosting polymer comprises 40% ethylene oxide and 60% vinyl acetate.

6. A compact liquid detergent composition according to claim 1 wherein the surfactant boosting polymer has a mean weight average molecular weight $M_w$ from 3000 to 100,000.

7. A compact liquid detergent composition according to claim 1 wherein the surfactant boosting polymer has a mean weight average molecular weight $M_w$ from 6000 to 45,000.

8. A compact liquid detergent composition according to claim 1 wherein the surfactant boosting polymer has a mean weight average molecular weight $M_w$ from 8000 to 30,000.

9. A compact liquid detergent composition according to claim 1 wherein the polydispersity $M_w/M_n$ of the surfactant boosting polymer is from 1 to 3, wherein the polydispersity $M_w/M_n$ is calculated by dividing the weight average molecular weight ($M_w$) by the number average molecular weight ($M_n$).

10. A compact liquid detergent composition according to claim 1 wherein the polydispersity $M_w/M_n$ of the surfactant boosting polymer is from 1.5 to 2.5, wherein the polydispersity $M_w/M_n$ is calculated by dividing the weight average molecular weight ($M_w$) by the number average molecular weight ($M_n$).

11. A compact liquid detergent composition according to claim 1 wherein the polydispersity $M_w/M_n$ of the surfactant boosting polymer is from 1.5 to 2.2, wherein the polydispersity $M_w/M_n$ is calculated by dividing the weight average molecular weight ($M_w$) by the number average molecular weight ($M_n$).

12. A compact liquid detergent composition according to claim 1 wherein said compact liquid detergent composition comprises 3% to 5% surfactant boosting polymer by weight of the composition.

13. A compact liquid detergent composition according to claim 1 wherein said surfactant is selected from the group consisting of $C_{11}$-$C_{18}$ alkyl benzene sulfonates (LAS), $C_{10}$-$C_{20}$ branched-chain and random alkyl sulfates (AS), $C_m$-$C_{is}$ alkyl ethoxy sulfates ($AE_xS$) wherein x is from 1-30, mid-chain branched alkyl sulfates, mid-chain branched alkyl alkoxy sulfates, $C_{10}$-$C_{18}$ alkyl alkoxy carboxylates comprising 1-5 ethoxy units, modified alkylbenzene sulfonate (MLAS), $C_{12}$-$C_{20}$ methyl ester sulfonate (MES), $C_{10}$-$C_{18}$ alpha-olefin sulfonate (AOS), $C_6$-$C_{20}$ sulfosuccinates, and mixtures thereof.

14. A compact liquid detergent composition according to claim 1 wherein said compact liquid detergent comprises surfactant from 1% to 80% by weight of the composition.

15. A compact liquid detergent composition according to claim 1 wherein said compact liquid detergent comprises surfactant from 5% to 50% by weight of the composition.

16. A compact liquid detergent composition according to claim 1 wherein said surfactant is linear alkylbenzene sulphonate (LAS), said compact liquid detergent composition comprises from 4% to 30% linear alkylbenzene sulphonate by weight of the composition.

17. A compact liquid detergent composition according to claim 1 wherein said surfactant is linear alkylbenzene sulphonate (LAS), said compact liquid detergent composition comprises from 5% to 28% linear alkylbenzene sulphonate by weight of the composition.

18. A compact liquid detergent composition according to claim 1 wherein said surfactant is linear alkylbenzene sulphonate (LAS), said compact liquid detergent composition comprises from 7% to 25% linear alkylbenzene sulphonate by weight of the composition.

19. A compact liquid detergent composition according to claim 1 wherein said compact liquid detergent composition comprises from 6% to 10% fatty acids or their salts by weight of the composition.

20. A compact liquid detergent composition according to claim 1, wherein said fatty acid or their salts are C12-C18 saturated and/or unsaturated fatty acids.

21. A compact liquid detergent composition according to claim 1 further comprising an opacifier and an antioxidant.

22. A compact liquid detergent composition according to claim 1, wherein said C1-C4 alkanolamine comprises monoethanolamine.

23. A compact liquid detergent composition according to claim 22, wherein the monoethanolamine buffers the composition to a pH of about 7.5.

* * * * *